US006896262B2

(12) United States Patent
Loveman et al.

(10) Patent No.: US 6,896,262 B2
(45) Date of Patent: May 24, 2005

(54) METHOD OF PLAYING A GAME AND AN APPARATUS SUITABLE THEREFOR

(75) Inventors: Stanford L. Loveman, Solon, OH (US); Edward D. Greenberger, North Palm Beach, FL (US)

(73) Assignee: Rankum LLC, Solon, OH (US)

( * ) Notice: Subject to any disclaimer, the term of this patent is extended or adjusted under 35 U.S.C. 154(b) by 0 days.

(21) Appl. No.: 10/601,449

(22) Filed: Jun. 23, 2003

(65) Prior Publication Data

US 2004/0026856 A1 Feb. 12, 2004

Related U.S. Application Data

(60) Provisional application No. 60/390,978, filed on Jun. 24, 2002.

(51) Int. Cl.[7] ..... A63F 3/00
(52) U.S. Cl. ..... 273/243; 273/430
(58) Field of Search ..... 273/243, 430, 273/431; 434/232, 128

(56) References Cited

U.S. PATENT DOCUMENTS

| | | | | |
|---|---|---|---|---|
| 3,815,919 A | | 6/1974 | Cain et al. | |
| 3,831,946 A | | 8/1974 | Denalsky | |
| 4,124,214 A | | 11/1978 | Pavis | |
| 4,273,337 A | * | 6/1981 | Carrera et al. | 273/243 |
| 4,315,627 A | | 2/1982 | Schlegel et al. | |
| 4,449,710 A | | 5/1984 | Davis | |
| 4,557,485 A | | 12/1985 | Lardon | |
| 4,635,939 A | | 1/1987 | Makow | |
| 5,120,066 A | | 6/1992 | Cohen | |
| 5,158,301 A | | 10/1992 | Martukovich, Jr. | |
| 5,308,079 A | | 5/1994 | Dreznick et al. | |
| 5,480,157 A | | 1/1996 | Plummer | |
| 5,882,008 A | | 3/1999 | Siegesmund | |
| 6,139,016 A | | 10/2000 | Plato | |
| 6,267,379 B1 | * | 7/2001 | Forrest et al. | 273/431 |

* cited by examiner

*Primary Examiner*—Vishu K. Mendiratta
(74) *Attorney, Agent, or Firm*—Fay, Sharpe, Fagan, Minnich & McKee, LLP

(57) ABSTRACT

A method of playing a game that includes the steps of providing a plurality of categories, selecting a category from the plurality of categories and communicating the categories to one or more teams of two or more players. Other steps include two or more of the players of one of more of the teams recording one or more responses to the category and ranking the one or more responses in an order, comparing the ranked responses between two or more of the players on the one or more teams, and determining a point total for each team based at least in part on the comparison of the ranked responses. Another step includes taking an action based at least in part on the point total.

26 Claims, 4 Drawing Sheets

| Team Member #1 | |
|---|---|
| George Washington | 1 |
| Abraham Lincoln | 2 |
| Bill Clinton | 4 |
| Franklin Roosevelt | 5 |
| John Kennedy | 3 |

| Team Member #2 | |
|---|---|
| George Washington | 1 |
| John Kennedy | 5 |
| Abraham Lincoln | 2 |
| Ronald Reagan | 3 |
| Franklin Roosevelt | 4 |

FIGURE 5

| Team Member #1 | |
|---|---|
| George Washington | 1 |
| Abraham Lincoln | 2 |
| Bill Clinton | 4 |
| Franklin Roosevelt | 5 |
| John Kennedy | 3 |

| Team Member #2 | |
|---|---|
| George Washington | 1 |
| John Kennedy | 5 |
| Abraham Lincoln | 2 |
| Ronald Reagan | 3 |
| Franklin Roosevelt | 4 |

FIGURE 6

| Team Member #1 | |
|---|---|
| George Washington | 1 |
| Abraham Lincoln | 2 |
| Bill Clinton | 4 |
| Franklin Roosevelt | 5 |
| John Kennedy | 3 |

| Team Member #2 | |
|---|---|
| George Washington | 1 |
| John Kennedy | 5 |
| Abraham Lincoln | 2 |
| Ronald Reagan | 3 |
| Franklin Roosevelt | 4 |

FIGURE 7

METHOD OF PLAYING A GAME AND AN APPARATUS SUITABLE THEREFOR

This application claims the benefit of U.S. Provisional Application No. 60/390,978, filed Jun. 24, 2002, which is hereby incorporated herein by reference in its entirety.

BACKGROUND OF THE INVENTION

This invention relates generally to amusement devices and, more particularly, to a method of playing a game and an apparatus suitable for use in playing a game according to such method.

The usefulness of game apparatuses and methods of playing games for amusement purposes are well known. Many games, however, have been developed for groups of people in which play proceeds on a one-at-a-time basis. While such games may be enjoyable, the entertainment value can often be reduced while each player is waiting for his or her turn to come around again. Accordingly, it has been considered desirable to develop a new method of playing a game, particularly, a game that is suitable for groups of people and in which all persons generally participate in each round of play throughout the game.

SUMMARY OF THE INVENTION

A method of playing a game is provided that comprises the steps of providing a plurality of categories, selecting a category from the plurality thereof and communicating the category to one or more teams each having two or more players. The method also includes a step in which two or more players of one or more teams each record one or more responses to the selected category and rank the one or more responses in an order. In a further step of the subject method, the ranked responses of two or more of the players of each team are compared, and a point total based at least in part on the comparison is determined. Yet another step includes taking an action based at least in part on the point total.

Another method of playing a game is provided that comprises the steps of providing a game board, a plurality of game pieces, plurality of categories and a selection device, with the game board having a path formed from a plurality of discrete spaces extending along the game board. Other steps include selecting a category from the plurality thereof and communicating the selected category to at least two players on at least one team. The method also includes the step of the at least two players of the at least one team recording one or more responses to the selected category and ranking the responses in an order. Further steps include comparing the ranked responses between at least two players of at least one team, and determining a point total for each team based at least in part on the comparison of the ranked responses of each team. Still a further step includes at least one team moving an associated one of the plurality of game pieces along the path of the game board a number of spaces proportional to the point total for the team.

A further method of playing a game is provided that is comprised of the step of communicating a category selected from a plurality of categories to a plurality of teams, with each team having two or more players. Another step includes providing a recording medium suitable for each of the two or more players of each of the plurality of teams to record one or more responses to the category. A further step includes prompting at least two of the two or more players on at least one of the plurality of teams to record one or more responses to said category and rank the one or more responses in an order. Still another step includes comparing the one or more ranked responses between at least two of the two or more players on at least one of the plurality of teams and determining a point total based at least in part on the comparison of the ranked responses. Yet another step includes taking an action based at least in part on the point total.

BRIEF DESCRIPTION OF THE DRAWINGS

FIG. 5 illustrates a pair of response lists in accordance with a step illustrated in FIG. 3.

FIG. 6 illustrates the response lists of FIG. 5 shown highlighting the common responses.

FIG. 7 illustrates the response lists of FIG. 6 shown highlighting the commonly ranked responses.

DETAILED DESCRIPTION OF THE INVENTION

Figure 1:
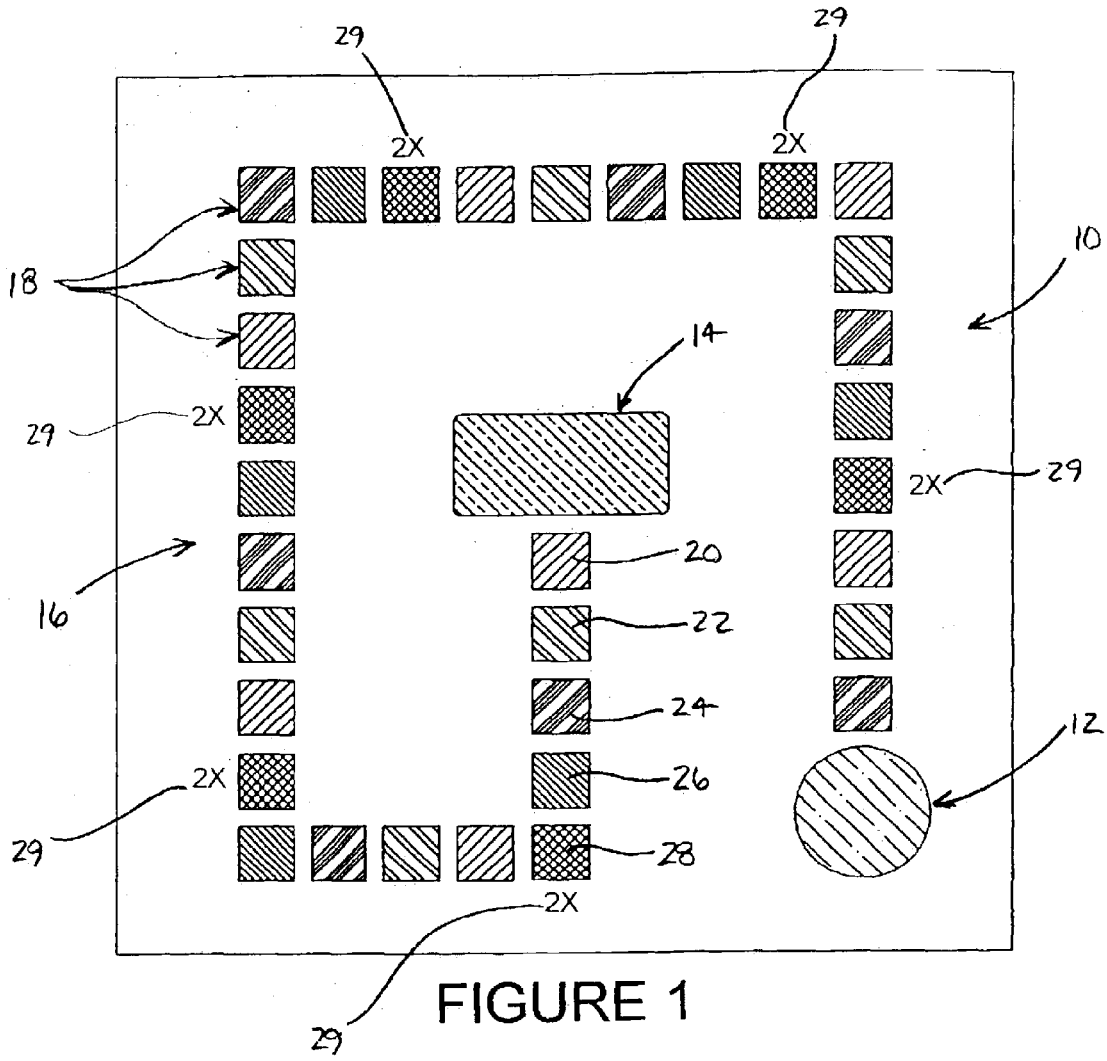
FIG. 1 illustrates one embodiment of a game board for use in association with one method of playing a game in accordance with the present invention.

By way of establishing initial background information, the following discussion of a game played in accordance with the steps comprising the present invention is provided. However, it is to be distinctly understood that the discussion provided hereinafter is merely one example of a game played in accordance with said steps and is not to be interpreted as a limitation thereof.

A game played in accordance with the steps of the present invention is well suited for a group of people divided into a plurality of teams, each having two or more players. A method of playing a game in accordance with the present invention includes the selection or provision of a category, such as a randomly selected category, for example, and communication of that category to the teams participating in that round of play. For example, the category may be related to toothpastes, plays, actors, amusement parks or $20^{th}$ century scandals. It should be appreciated, however, that the categories could be of any suitable type or format for which a list of responses can be compiled. Furthermore, categories can be posed as statements, commands, questions, or in any other manner suitable for conveying a topic to the teams playing the game. Additional examples of categories could include "Phrases that include the word HOME.", "List five types of cheese.", or "What are America's favorite sports?"

Each category can be associated with one of a plurality of category indicators, such as a symbol; character or group of characters, color or pattern, for example. The preferred uses of such an associated category indicator will be discussed in detail hereinafter. However, as an example, the category indicator may be useful in a random selection process or step of playing a game, in determining a team's score for a particular round, or in advancing a game piece of a team along a game board.

Once the category has been communicated to the teams, two or more players of one or more of the teams should record one or more and up to a predetermined number of responses in or associated with that category. For example, in response to the category "Top Five U.S. Presidents," a player might list George Washington, Abraham Lincoln, Bill Clinton, Franklin Roosevelt and John F. Kennedy.

Having recorded one or more responses on a suitable recording medium, each player then ranks his or her responses in an order. For example, a player may rank his or her list of responses as follows:

| Response | Rank |
|---|---|
| George Washington | 1 |
| Abraham Lincoln | 2 |
| Bill Clinton | 4 |
| Franklin Roosevelt | 5 |
| John F. Kennedy | 3 |

Once each player on each participating team has recorded and ranked his or her responses, all the response lists are revealed and the responses are compared between the players of each team. Based on the number of common responses and/or the associated rank of those responses between two or more players on each team, a point total is determined for each team for the round. Such rounds of play are repeated until a winning team has been determined. The winning team can be determined by any suitable calculation or device. For example, a winning team may be determined by reaching a predetermined number of cumulative points, by advancing a game piece along a game board in association with the points acquired in each round and being first to reach a designated area, or by so reaching the designated area and being the first to get a predetermined number of common answers in response to a final category, for example.

Having provided a basic background of one embodiment of a game played in accordance with the steps comprising the method of the present invention, a more detailed discussion of a method of playing a game in accordance with the present invention and an apparatus therefore can be undertaken. To simplify the discussion of the present method, the steps comprising the method shall be grouped into "stages," such as a setup stage, a competition stage, a scoring stage and a winning stage. However, it should be appreciated that such grouping is provided only for the simplification and ease of understanding of the discussion hereinafter set forth, and should not be considered a requirement of discrete stages of a game, or interpreted as a definitive aspect or limitation of the subject method. What's more, many of the steps identified and discussed herein are optional steps. Furthermore, it is to be distinctly understood that the steps disclosed herein may be used in various other combinations, which may be inclusive or exclusive of many of said steps, without departing from the principles of the present invention.

Numerous steps may be completed prior to the actual initiation of competitive play of the present game. Such steps will be discussed herein as occurring during the setup stage of a game. As a first step, a group of people should be separated into a plurality of teams, with two or more members making up each team. Each team member should be provided with an apparatus or recording medium for recording his or her responses, such as a writing surface and associated writing instrument or an electronic display and a keyboard, for example. A game board can optionally be provided, in which case, each team should be provided a unique and identifiable game piece. It will be appreciated that the game board can take the form of a typical game board, a graphically represented game board on a computer screen or any other electronically generated arrangement providing a game path, if the game board is to be included in the first instance. It will be further appreciated that the game piece can be any suitable apparatus or graphical representation suitable for indicating the team's relative position on the game path of the game board. Furthermore, a die, spinner or other random selection device, electronic or non-electronic, can also be provided. Finally, a plurality of categories should be provided, preferably in the form of a plurality of game cards, each having one or more categories listed thereon. However, it will be appreciated that categories can be provided in other manners, such as random computer generation on a display screen, for example. Such as might be the case on a game show or computer game, for example. In which case, a random selection device may not be provided. Prior to the start of a round of play, it may be desirable to select a first team to actually initiate play. This may be done by any suitable manner, method or calculation, such as being the first team to roll a predetermined side of a die or land on a predetermined space of a spinner, or simply by selecting the first team based on a predetermined personal characteristic, such as the team with a member whose last name is first alphabetically, for example.

Referring now in greater detail to the drawings, wherein the showings are for the purpose of illustrating preferred embodiments of the invention only, and not for the purpose of limiting the invention, FIG. 1 illustrates a game board 10 having a start area 12, a finish area 14 and a game path 16. The game path includes a plurality of spaces 18 extending adjacent one another between the start and finish areas. It will be appreciated, however, that any suitable game path can be used, including continuous game paths of circular or any other suitable shape or configuration. Each of the spaces shown in FIG. 1 includes one of numerous indicia 20, 22, 24, 26 and 28. The indicia shown in FIG. 1 are line patterns. However, it will be appreciated that the indicia may be of any suitable type or form, such as symbols, characters or colors, for example. Furthermore, it will be appreciated that one or more of the spaces can also or alternatively include indicia other than indicia 20–28 set out hereinbefore. Indicia, such as "2X" shown as item 29 in FIG. 1, can provide an indication or instruction to limit the teams participating in that round, to double a team's score or to allow a team to select the category of its choice, for example. Additionally, if a random selection device is provided, such as a die (not shown) or a spinner (not shown), the device should preferably include each of indicia 20–28 and can also optionally include other additional indicia as described hereinbefore.

Figure 2:
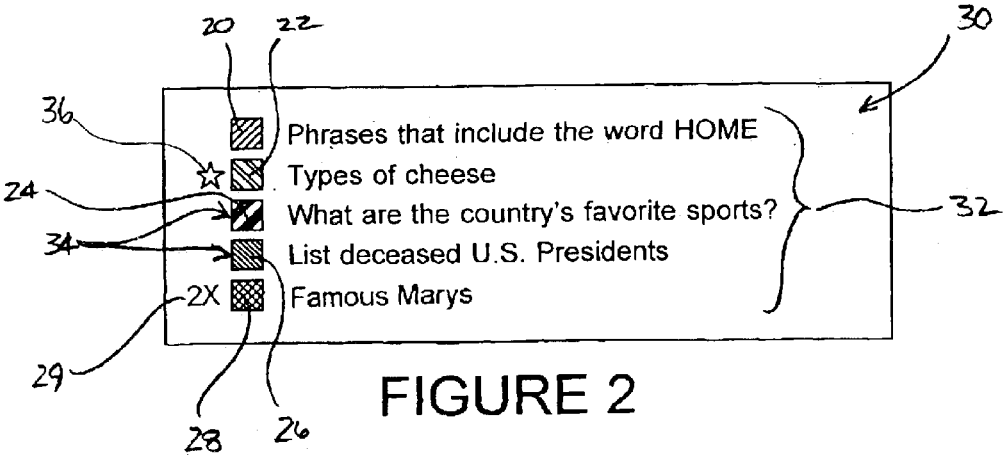
FIG. 2 illustrates one embodiment of a game card for use in association with one method of playing a game in accordance with the present invention.

FIG. 2 illustrates a game card 30 having a plurality of categories 32 listed thereon and a category indicator 34 associated with each of the categories. Each of the category indicators should preferably be associated with a different one of the indicia 20–28. Additional indicia or other symbols or characters, such as a star 36 or a "2X" shown as item 29, can also be associated with one or more categories, as shown in FIG. 2. Such additional indicia may provide any desirable instruction, such as an instruction to limit the teams participating, to double a team's score in the present round or to allow a team to select any category for the present round, for example.

Having completed a series of steps comprised from the foregoing discussion that may be employed during the setup stage of a game and with each team having placed its game piece in a designated area, such as start area 12 of game board 10, for example, if a game board is to be used. Thereafter, the teams may begin play by initiating a sequence of steps comprising the competition stage of a game. As discussed with regard to the setup stage and the other stages to be discussed hereinafter, many of the steps identified and discussed herein are optional, and can be used in other combinations, and, in many cases, in the alternative in combination with other steps.

Figure 3:
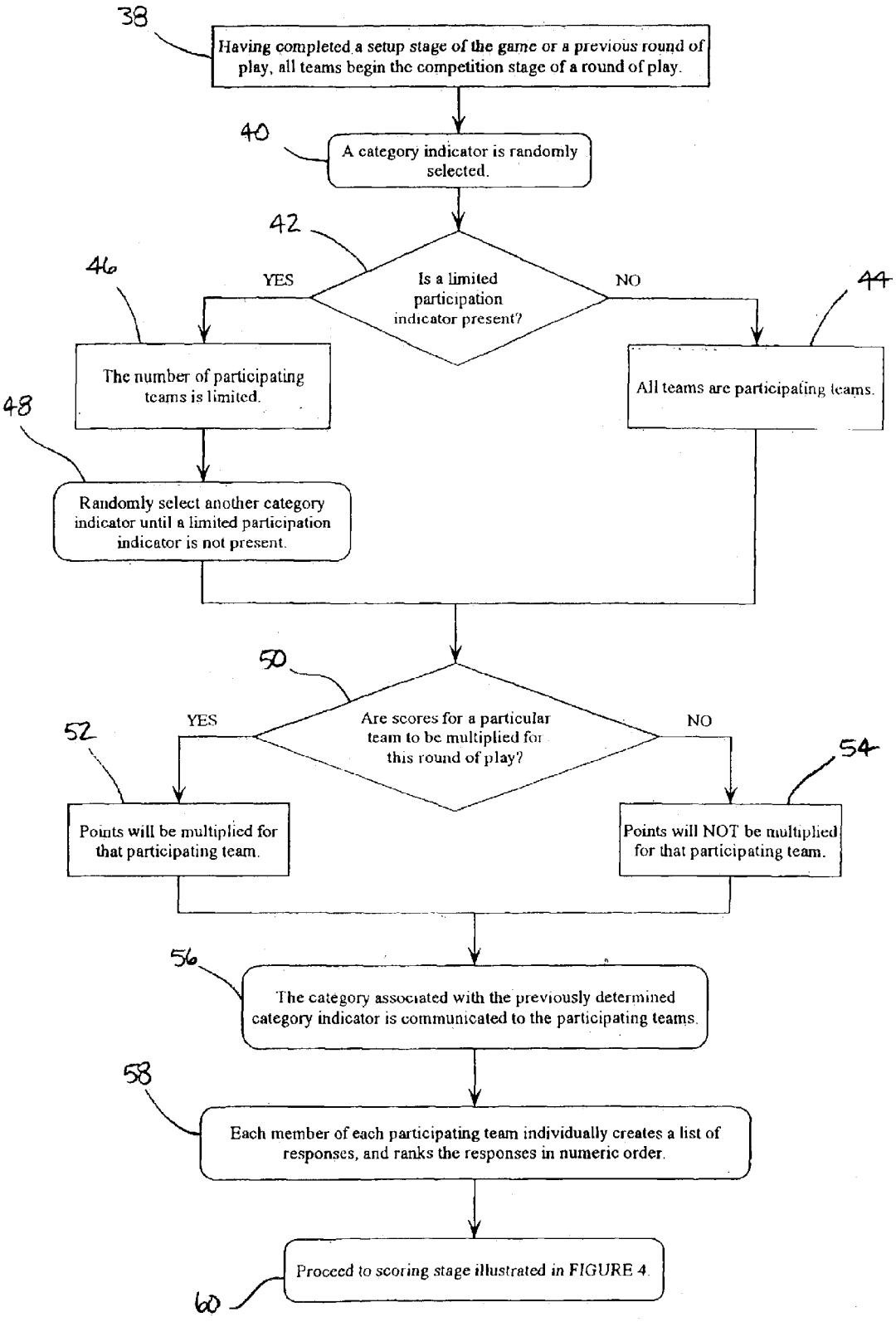
FIG. 3 is a flow chart illustrating one embodiment of a series of steps comprising a portion of a round of play in accordance with one method of the present invention.

FIG. 3 is a flow chart diagram illustrating a series of steps comprising a competition stage of a game played in accordance with the present invention. It will be appreciated that a competition stage is the first portion of a round of play, and that a series of steps comprising a competition stage will be initiated either after the completion of a setup stage or an earlier round of play, as indicated by item 38 in FIG. 3. As a preferred initial step, a category indicator is randomly selected, as shown by item 40. This can be accomplished by any suitable manner or device, such as the roll of a die, a spin of a spinner or by the use of an electronic or computer selection device, for example. The random selection of the category indicator may be initiated by one of the members of one of the teams, or by a third party, such as a game show host, for example.

Once a category indicator has been randomly selected, an inquiry can be made as to whether or not a limited participation indicator is present, as indicated by item 42. The limited participation indicator preferably provides an instruction to limit the number of teams participating in the present round of play to a lesser, predetermined number of teams. If no limited participation indicator is present, as shown by item 44, then all teams are participating teams and will compete in the present round of play. If a limited participation indicator is present as illustrated by item 46, then the participation in the present round of play will preferably be limited to a predetermined number of participating teams that is less than the total number of teams playing the game. For example, the round of play may be limited solely to the team making the random selection. In the case where a device, such as a die, spinner or other device, has been used to randomly select a category indicator, it will be appreciated that it may be necessary to again roll the die, spin the spinner or cycle the electronic or computer selection device until a category indicator is showing or indicated. This step is shown as item 48 in FIG. 3. It is also contemplated that cards, markers or other objects (not shown) may be won or otherwise obtained by teams that may allow the possessing team to "join in" the round of play that has been otherwise limited.

Item 50 in FIG. 3 then prompts an inquiry into whether the score for a team should be multiplied, such as doubled, for example, for the present round of play. Preferably, this will be determined on a team-by-team basis such that some teams may have their score for the round multiplied while other teams may not, as respectively indicated by items 52 and 54 of FIG. 3. The determination of whether a team's score for the round is to be multiplied may be made by any suitable manner or criteria. For example, if a game board is being used and the indicia on the space presently occupied by a team's game piece is the same as the indicia on the selected category indicator, then the team's points may be multiplied, such as being doubled, for example. The next step, indicated by item 56, is to communicate the category associated with the selected category indicator to all the participating teams, recalling that the participating teams may include all teams or may be limited to one or more teams as earlier determined. It will be appreciated that the category may be communicated to the participating teams by a third person, such as a game show host. Two or more players on each participating team then secretly and independently prepares one or more and up to a predetermined number of responses to the category, and ranks the responses in an order, such as a numerical order, as indicated by item 58 of FIG. 3, for example.

Once the two or more players of each participating team has recorded and ranked one or more responses, the round of play can proceed to the scoring stage as shown by item 60. It should be understood, however, that other steps might be included in the foregoing competition stage. For example, a team may have won or otherwise obtained a card or other marker (not shown) allowing the possessing team to have a "free choice" of category, which could overrule the random selection from a device, such as a die or spinner.

Figure 4:
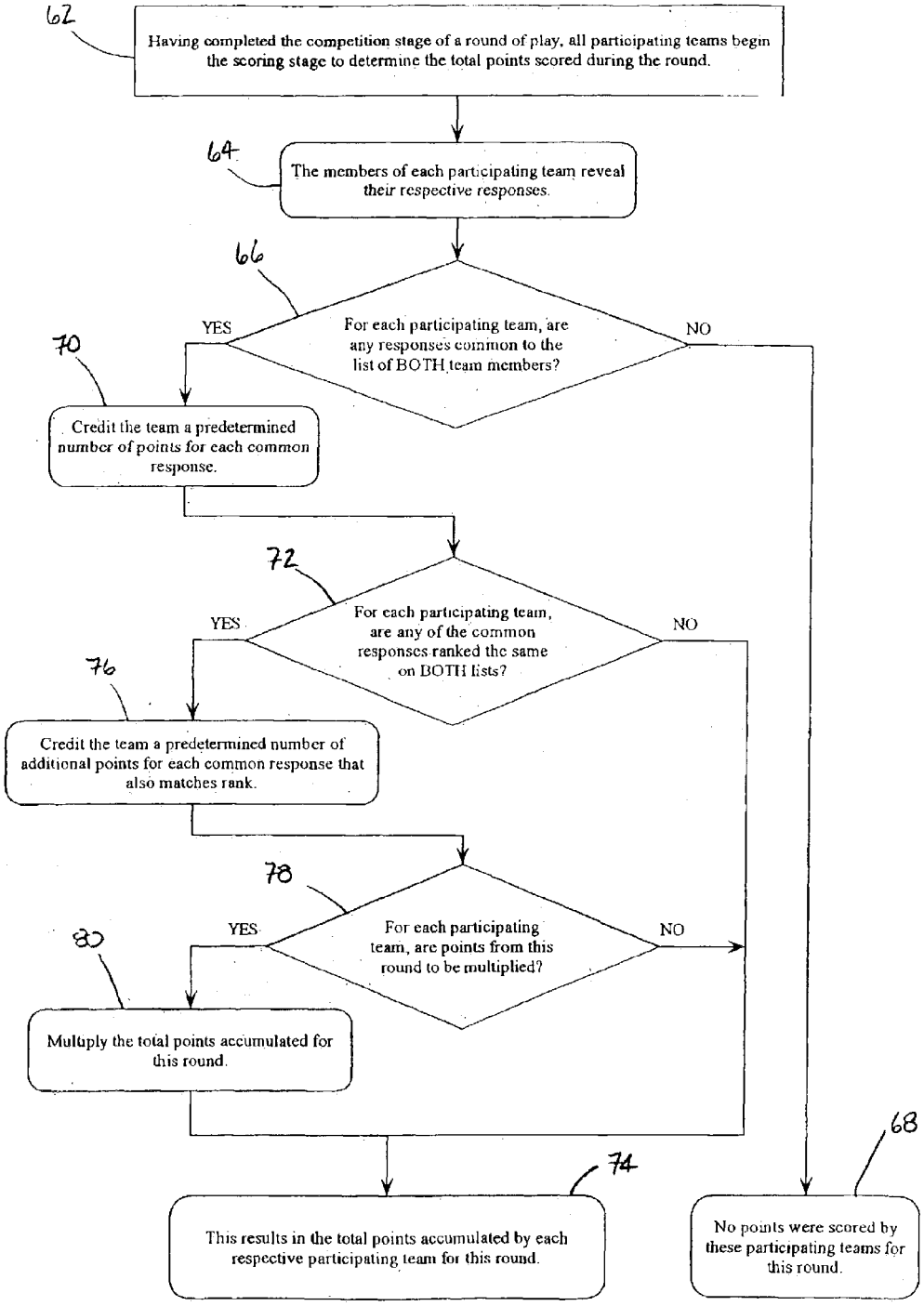
FIG. 4 is a flow chart illustrating one embodiment of a series of steps comprising a further portion of a round of play in accordance with one method of the present invention.

The scoring stage represents a series of steps taken after the completion of each competition stage, as suggested by item 62 in FIG. 4. During the scoring stage, various steps will be taken to determine the total points scored by each team for the current round of play. As shown in item 64 of FIG. 4, the initial step of the scoring stage is preferably to have each player of each participating team reveal his or her responses. FIGS. 5–7 illustrate a side-by-side comparison of a team's responses to the category "Top Five U.S. Presidents." Specifically, FIG. 5 shows an example of a team's two response lists. Referring back to FIG. 4, item 66 inquires whether or not the two answer lists have any common responses. If a team has no common response, then the team scores no points for the round of play, as indicated by item 68. If a team has one or more common responses, then the team is awarded a predetermined number of points, such as one point, for example, for each common response as indicated by item 70. As an example, FIG. 6 illustrates that the lists of responses from FIG. 5 have four (4) common responses. If each common response were worth one (1) point, for example, then these responses would be worth four (4) points to the team.

The next step is preferably an inquiry as to whether any of the common responses were ranked the same on both team member's lists, as indicated by item 72 of FIG. 4. If there are no responses ranked the same on both lists, then the points awarded for common answers are the total points accumulated by the team for the present round, as shown in item 74. If, however, the two lists have one or more responses that are ranked the same, then a predetermined number of additional points may be awarded for each commonly ranked response, as shown in item 76. As an examples FIG. 7 illustrates that the lists of responses from FIG. 6 have two (2) responses that are commonly ranked. If each one of the common rankings is worth one additional point, for example, then these common rankings would be worth two (2) additional points, for a cumulative total of six (6) points for the team for this round of play.

Next, an inquiry is made as to whether or not any team or teams have the advantage of a score multiplier, as shown as item 78 in FIG. 4. Recall that during an earlier portion of the current round of play, a determination was made regarding the multiplication of points, shown as items 50–54 in FIG. 3. Any such multiplication of points should preferably be applied here, as indicated by item 80. Otherwise, the cumulative point total from items 66 and item 72, if applicable, stands as the team total for the round of play, as indicated by item 74. It is also contemplated, however, that a team may win or otherwise acquire a card, marker or other object (not shown) that may allow a team to multiply or otherwise increase the team's score. Furthermore, it will be appreciated that the foregoing steps may be used in other combinations and in combination with other steps, and is intended to be an example of a series of steps for playing and scoring a round of play in a game played in accordance with the present invention and is not intended to be a limitation or the exclusive manner of playing and scoring a game. For example, in another embodiment the total score could be calculated solely on the points from commonly ranked responses.

The steps discussed hereinbefore with regard to the competition and scoring stages, which comprise a round of play, should be repeated until a winning team has been determined. A winning team can be determined by any suitable action or series of actions, such as totaling a cumulative score over repeated rounds of play, moving a game piece or other position indicator along a game path, or any other suitable action for determining a winning team. For example, the team winning the game may simply be the first to reach a predetermined cumulative point total, such as one hundred (100) points, for example. Or, if a game board is being used, the winning team may be the first to reach a designated area on the game board, such as finish area 14 shown in FIG. 1. This being accomplished by advancing the team's game piece along a game path, such as a game path 16 of FIG. 1, a number of spaces each round in relation to the total points received in each round.

A further step can optionally be included in which a team or teams, after reaching a predetermined goal of cumulative points or a pre-defined area on a game board, for example, may preferably be asked to respond to one or more final categories and meet a predetermined result before actually being found to be the winning team. For example, a team upon reaching the pre-defined area of the game board, may be given an opportunity to win the game by having each player of that team record a single response to a communicated category, which may be selected in any suitable manner. The two players would reveal their single responses and, if the answers match, that team is found to be the winning team. In cases where two or more teams have reached the predetermined goal, the teams may be asked to play a single response round, as discussed hereinbefore, together and repeat such rounds until a winning team is determined. It will be appreciated that various steps may be combined to determine a winning team, and that it is intended that the foregoing steps be combinable in various and different manners, both collectively and, in the alternative, to determine a winning team within the scope of a game played in accordance with the present invention. Additionally, it will be appreciated that steps from various other portions or stages of the game may be employed together or in the alternative throughout other aspects of the subject method of playing a game. It should be further appreciated that many of the steps disclosed herein are optional and may be excluded without departing from the principles of the present invention.

While the invention has been described with reference to the preferred embodiments and considerable emphasis has been placed herein on the steps and interrelationships between the steps of the embodiments disclosed, it will be appreciated that other embodiments of the invention can be made and that many changes can be made in the embodiments illustrated and described without departing form the principles of the invention. Obviously, modifications and alterations will occur to others upon reading and understanding the preceding detailed description. Accordingly, it is to be distinctly understood that the foregoing descriptive matter is to be interpreted merely as illustrative of the present invention and not as a limitation. As such, it is intended that the invention be construed as including all such modifications and alterations insofar as they come within the scope of the appended claims and the equivalents thereof.

What is claimed is:

1. A method of playing a game comprising the steps of:

a) providing a plurality of categories on a visually communicable game medium;

b) selecting a category from said plurality of categories and communicating said selected category to one or more teams of two or more players;

c) at least two of said two or more players of said one or more teams recording one or more responses to said selected category on a recording medium and ranking said one or more responses in an order;

d) comparing said ranked responses between said two or more players of said one or more teams and determining a point total for each of said one or more teams based at least in part on said comparison of said ranked responses; and, e) taking an action based at least in part on said point total.

2. A method according to claim 1, wherein each of said plurality of categories is associated with one of a plurality of category indicators and step b) further includes selecting one of said plurality of category indicators.

3. A method according to claim 2, wherein step a) further includes providing a selection device adapted to randomly indicate one of said plurality of category indicators, and step b) further includes utilizing said selection device.

4. A method according to claim 3, wherein said selection device is a multi-sided die, and step b) further includes rolling said die.

5. A method according to claim 1, wherein said one or more teams of two or more players in step b) includes at least two or more teams, and said method further comprises a step of limiting said two or more teams to a lesser number of participating teams.

6. A method according to claim 5 further comprising a step of determining by random selection if said two or more teams are to be limited prior to said step of limiting said two or more teams to a lesser number of participating teams.

7. A method according to claim 1, wherein said action in step e) includes forming a cumulative total.

8. A method according to claim 7 further comprising a step of repeating steps a) to e) until said cumulative total reaches a predetermined value.

9. A method according to claim 1, wherein said visually communicable game medium provided in step a) includes a plurality of cards each having at least one category thereon.

10. A method of playing a game comprising the steps of:

a) providing a game board, a plurality of game pieces, a plurality of categories on a same surface and a selection device, said game board having a path formed from a plurality of discrete spaces extending along said game board;

b) selecting a category from said plurality of categories;

c) communicating said selected category to at least two players on at least one team of a plurality of teams;

d) said at least two players on said at least one team individually recording one or more responses to said selected category each on a separate recording medium and individually ranking said one or more responses on said separate recording medium in an order;

e) comparing said ranked responses between said at least two players of said at least one team;

f) determining a point total for each of said at least one team based at least in part on said comparison of said ranked responses; and, g) said at least one team moving an associated one of said plurality of game pieces along said path of said game board a number of said spaces proportional to said point total.

11. A method of playing a game comprising the steps of:

a) providing a game board, a plurality of game pieces, a plurality of categories recorded on a same surface and a selection device, said game board having a path formed from a plurality of discrete spaces extending alone said game board;

b) selecting a category from said plurality of categories;

c) communicating said selected category to at least two players on at least one team of a plurality of teams;

d) said at least two players on said at least one team individually recording one or more responses to said selected category on a recordable medium and individually ranking said one or more responses on said recordable medium in an order;

e) comparing said ranked responses between said at least two players of said at least one team;

f) determining a point total for each of said at least one team based at least in part on said comparison of said ranked responses including a step of determining a first point sub-total based on a number of common responses; and, g) said at least one team moving an associated one of said plurality of game pieces along said path of said game board a number of said spaces proportional to said point total.

12. A method according to claim 11, wherein step f) further includes determining a second point sub-total based on said number of common responses that are also commonly ranked, and combining said first and second point sub-totals to form said point total.

13. A method according to claim 10 further comprising a step of multiplying said point total by a multiplier prior to step g).

14. A method according to claim 10 further comprising a step of repeating steps a) to g) until one of said plurality of game pieces reaches a pre-defined area of said game board.

15. A method of playing a game comprising the steps of:

a) communicating a category recorded on a game surface to a plurality of teams, each having two or more players;

b) providing a recording medium suitable for each of said two or more players of each of said plurality of teams to independently record one or more responses to said category;

c) prompting at least two of said two or more players on at least one of said plurality of teams to independently record one or more responses to said category and independently rank said one or more response in an order;

d) comparing said one or more ranked responses between at least two of said two or more players on said at least one of said plurality of teams;

e) determining a point total for each of said plurality of teams based at least in part on said comparison of said ranked responses; and, f) taking an action based at least in part on said point total.

16. A method according to claim 15 further comprising a step of providing a game path having a plurality of discrete spaces and a game piece displaceable along said game path.

17. A method according to claim 16, wherein said action in step f) further includes advancing said game piece along said game path a number of said discrete spaces correlated to said point total.

18. A method according to claim 15, wherein step e) further includes determining a number of responses common between said two or more players for each of said teams.

19. A method according to claim 18, wherein step e) further includes determining a number of common responses that are also commonly ranked.

20. A method according to claim 19, wherein step e) further includes assigning a number of points to at least one of said number of common responses and said number of commonly ranked responses.

21. A method according to claim 15 further comprising repeating steps a) to f) until a winning team is determined.

22. A method of playing a game comprising steps of:

a) providing a plurality of categories on a game surface;

b) selecting a category from said plurality of categories and communicating said selected category to one or more teams of two or more players;

c) at least two of said two or more players of said one or more teams independently recording one or more responses to said selected category on a recording medium and independently ranking said one or more responses in an order;

d) comparing said ranked responses between said at least two players on at least one of said teams and determining a point total for each of said at least one of said teams based at least in part on said comparison of said ranked responses; and, e) taking an action based at least in part on said point total.

23. A method according to claim 22, wherein step d) includes determining a number of common responses between said at least two players on at least one of said teams.

24. A method according to claim 23, wherein step d) includes determining a first point sub-total based on said number of common responses.

25. A method according to claim 23, wherein step d) includes determining a number of commonly ranked responses from said number of common responses.

26. A method according to claim 25, wherein step d) includes determining a first point sub-total based on said number of common responses and determining a second point sub-total based on said number of commonly ranked responses.

* * * * *